US011600931B2

(12) United States Patent
Wu et al.

(10) Patent No.: US 11,600,931 B2
(45) **Date of Patent: *Mar. 7, 2023**

(54) BASE STATION ANTENNA

(71) Applicant: CommScope Technologies LLC, Hickory, NC (US)

(72) Inventors: Bo Wu, Suzhou (CN); Xun Zhang, Suzhou (CN); Jian Zhang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/389,405

(22) Filed: Jul. 30, 2021

(65) Prior Publication Data

US 2021/0359427 A1 Nov. 18, 2021

Related U.S. Application Data

(63) Continuation of application No. 16/522,146, filed on Jul. 25, 2019, now Pat. No. 11,108,169.

(30) Foreign Application Priority Data

Jun. 24, 2019 (CN) ..... 201910546126.1

(51) Int. Cl.
*H01Q 21/29* (2006.01)
*H01Q 1/24* (2006.01)
*H01Q 1/52* (2006.01)

(52) U.S. Cl.
CPC ..... *H01Q 21/293* (2013.01); *H01Q 1/246* (2013.01); *H01Q 1/523* (2013.01)

(58) Field of Classification Search
CPC ..... H01Q 21/061; H01Q 21/293; H01Q 1/36; H01Q 1/246; H01Q 1/523
See application file for complete search history.

(56) References Cited

U.S. PATENT DOCUMENTS 5,589,843 A 12/1996 Meredith et al.
2004/0038714 A1 2/2004 Rhodes et al.
(Continued)

FOREIGN PATENT DOCUMENTS

CN 107834198 A 3/2018
KR 20110015423 A 2/2011
KR 20160018916 A 2/2016

OTHER PUBLICATIONS

Notification of Transmittal of the International Search Report and the Written Opinion of the International Searching Authority, or the Declaration, in corresponding PCT Application No. PCT/US2020/036629 (10 pages) (dated Sep. 25, 2020).
(Continued)

*Primary Examiner* — Henry Luong
(74) *Attorney, Agent, or Firm* — Myers Bigel, P.A.

(57) ABSTRACT

The present invention relates to a base station antenna, comprising: a plurality of first radiating elements that are arranged as a first vertically-extending array; a plurality of second radiating elements that are arranged as a second vertically-extending array, where the second radiating elements are staggered in the vertical direction with respect to the first radiating elements; wherein phase centers in an azimuth plane for first sub-arrays of the first radiating elements are substantially the same as phase centers in the azimuth plane for respective third sub-arrays of the second radiating elements, and wherein the first sub-arrays each have a first number of first radiating elements and the third sub-arrays each have a second number of second radiating elements, the first number being different than the second number. This can effectively improve the pattern of the base station antenna.

20 Claims, 4 Drawing Sheets

(56) References Cited

U.S. PATENT DOCUMENTS

| | | | | |
|---|---|---|---|---|
| 2004/0178964 | A1 | 9/2004 | Gottl et al. | |
| 2005/0046514 | A1 | 3/2005 | Janoschka | |
| 2009/0015498 | A1 | 1/2009 | Deng et al. | |
| 2016/0033632 | A1 | 2/2016 | Searcy et al. | |
| 2017/0365921 | A1* | 12/2017 | Webb | H01Q 3/36 |
| 2018/0034518 | A1 | 2/2018 | Schulz et al. | |
| 2018/0309210 | A1 | 10/2018 | Sudo | |

OTHER PUBLICATIONS

Extended European Search Report corresponding to European Application No. 19193007.2 (20 pages) (dated Mar. 2, 2020).

* cited by examiner

BASE STATION ANTENNA

CROSS-REFERENCE TO RELATED APPLICATION

The present application is a continuation of and claims priority from U.S. application Ser. No. 16/522,146 filed Jul. 25, 2019, which claims priority under 35 U.S.C. § 119 to Chinese Patent Application No. 201910546126.1 filed Jun. 24, 2019, the entire contents of which are incorporated herein by reference.

TECHNICAL FIELD

The present invention relates to radio communications. More specifically, the present invention relates to base station antennas for cellular communication systems.

BACKGROUND

Base station antennas for wireless communication systems are used to transmit Radio Frequency ("RF") signals to, and receive RF signals from, fixed and mobile users of a cellular communications service. Base station antennas often include a linear array or a two-dimensional array of radiating elements, such as crossed dipole or patch radiating elements. In order to increase system capacity, beam-forming base station antennas are now being deployed that include multiple closely-spaced linear arrays of radiating elements that are configured for beam-forming. A typical objective with such beam-forming antennas is to generate a narrow antenna beam in the azimuth plane. This increases the power of the signal transmitted in the direction of a desired user and reduces interference.

If the linear arrays of radiating elements in a beam-forming antenna are closely spaced together, it may be possible to scan the antenna beam to very wide angles in the azimuth plane (e.g., azimuth scanning angles of 60°) without generating significant grating lobes. However, as the linear arrays are spaced more closely together, mutual coupling increases between the radiating elements in adjacent linear arrays, which degrades other performance parameters of the base station antenna such as the co-polarization performance. To maintain a close spacing between adjacent linear arrays of a beam-forming antenna while increasing the separation between radiating elements in adjacent linear arrays, it may be desirable to vertically stagger adjacent linear arrays, which increases the physical separation between "adjacent" radiating elements in neighboring linear arrays. This staggered configuration reduces mutual coupling between neighboring elements, leading to increased port-to-port isolation.

However, the staggered arrangement of the linear arrays of radiating elements may cause the equivalent phase centers of adjacent linear arrays of radiating elements to be offset from each other, thereby creating a spatial phase difference between each pair of adjacent linear arrays of radiating elements. The spatial phase difference may distort the radiation pattern ("antenna beam") of the base station antenna. Moreover, it may also be desirable to electronically adjust the elevation angle of the antenna beams generated by the beam-forming antenna to adjust the coverage area of the antenna in the elevation plane. This can be accomplished for each linear array separately using electro-mechanical phase shifters. Unfortunately, however, the amount of distortion to the antenna beam caused by the offset in the equivalent phase centers of adjacent linear arrays may increase as the applied electrical downtilt angle is increased. In order to compensate for this distortion, different amplitude and/or phase weights may be applied to the different linear arrays of radiation elements. The inclusion of such a compensation system, however, may increase the design difficulty and/or cost of the antenna system.

SUMMARY

Thus, an object of the present invention is to provide a base station antenna capable of overcoming at least one drawback in the prior art.

According to a first aspect of the present invention, a base station antenna is provided. The base station antenna comprises a plurality of linear arrays of radiating elements and a plurality of phase shifters, each phase shifter configured to pass radio frequency (RF) signals to a corresponding one of the linear arrays, characterized in that, each linear array of radiating elements comprises one or more first sub-arrays of radiating elements and one or more second sub-arrays of radiating elements, each first sub-array including n adjacent radiating elements, and each second sub-array including m adjacent radiating elements, where n is greater than m, wherein each first sub-array of radiating elements in each linear array is electrically connected to a respective one of a first subset of outputs of the respective phase shifter that corresponds to the linear array, and each second sub-array of radiating elements is electrically connected to a respective one of a second subset of outputs of the respective phase shifter that corresponds to the linear array, wherein the plurality of linear arrays of radiating elements are arranged spaced apart from each other in a first direction, and the radiating elements in each of the linear arrays of radiating elements are arranged in a second direction that is substantially perpendicular to the first direction, and two adjacent linear arrays of radiating elements are staggered with respect to one another in the second direction, wherein the first sub-arrays of radiating elements and the second sub-arrays of radiating elements in a first of the linear arrays of radiating elements are arranged in a first order and the first sub-arrays of radiating elements and the second sub-arrays of radiating elements in a second of the linear arrays of radiating elements that is adjacent the first of the linear arrays of radiating elements are arranged in a second order that is different from the first order, and the first sub-arrays of radiating elements in the first of the linear arrays of radiating elements are located, in the first direction, on the direct left or right side of the second sub-arrays of radiating elements corresponding to the first sub-arrays of radiating elements in the second of the linear arrays of the radiating elements.

According to embodiments of the present invention, the advantages of staggered arrangement of the arrays of radiating elements are maintained while staggering of the phase centers is reduced or even eliminated as much as possible by optimized distribution of the arrays of radiating elements for the base station antenna, thereby improving the RF performance of the base station antenna.

In some embodiments, the extension range in the second direction of each second sub-array of radiating elements is within the extension range in the second direction of a corresponding one of the first sub-arrays of radiating elements.

In some embodiments, the n radiating elements in each first sub-array of radiating elements are electrically connected to the respective ones of the first subset of outputs of the respective phase shifter that corresponds to the linear array via a corresponding power divider and/or a signal transmission line, and the m radiating elements in each second sub-array of radiating elements in each linear array are electrically connected to the respective ones of the second subset of outputs of the respective phase shifter that corresponds to the linear array via a corresponding power divider and/or a signal transmission line.

In some embodiments, the RF signals received by the n radiating elements in a first sub-array of radiating elements of the first of the linear arrays from a first feed node of the base station antenna all have a same first phase value, and the RF signals received by the m radiating elements in a second sub-array of radiating elements of the first of the linear arrays from a second feed node all have a same second phase value that is different from the first phase value.

In some embodiments, each array of radiating elements at least partially comprises alternately arranged first sub-arrays of radiating elements and second sub-arrays of radiating elements.

In some embodiments, at least one of the first sub-arrays of radiating elements in at least one of the arrays of radiating elements does not have a corresponding second sub-array of radiating elements in the adjacent array of radiating elements, and/or at least one of the second sub-arrays of radiating elements in at least one of the arrays of radiating elements does not have a corresponding first sub-array of radiating elements in the adjacent array of radiating elements.

In some embodiments, phase centers of the first sub-arrays of radiating element in each of the arrays of radiating elements are offset from phase centers of the corresponding second sub-arrays of radiating elements in the adjacent array of radiating elements by an amount less than the amount by which two adjacent arrays of radiating elements are staggered in the second direction.

In some embodiments, the upper limit of the ratio of the amount by which phase centers of the first sub-arrays of radiating elements in each array of radiating elements are offset from phase centers of the corresponding second sub-arrays of radiating elements in the adjacent array of radiating elements to the amount by which two adjacent arrays of radiating elements are staggered in the second direction is one of the following values: 0.9, 0.8, 0.7, 0.6, 0.5, 0.4, 0.3, 0.2, 0.1 and 0.05.

In some embodiments, phase centers of the first sub-arrays of radiating element in each of the arrays of radiating elements are substantially aligned with phase centers of the corresponding second sub-array of radiating elements in the adjacent array of radiating elements respectively.

In some embodiments, n=m+1.

In some embodiments, each of the arrays of radiating elements includes one or more first sub-arrays of radiating elements each composed of two radiating elements, and one or more second sub-arrays of radiating elements each composed of one radiating element; each of the arrays of radiating elements includes one or more first sub-arrays of radiating elements each composed of three radiating elements, and one or more second sub-arrays of radiating elements each composed of two radiating elements; each of the arrays of radiating elements includes one or more first sub-arrays of radiating elements each composed of four radiating elements, and one or more second sub-arrays of radiating elements each composed of three radiating elements; or each of the arrays of radiating elements includes one or more first sub-arrays of radiating elements each composed of five radiating elements, and one or more second sub-arrays of radiating elements each composed of four radiating elements.

In some embodiments, two adjacent arrays of radiating elements are staggered in the second direction such that the feed point of each radiating element in one array of radiating elements is within the spacing between the feed points of two adjacent radiating elements in the other array of radiating elements in the second direction.

In some embodiments, the amount by which two adjacent arrays of radiating elements are staggered in the second direction is in the range of 0.2 to 0.4 times the wavelength corresponding to the center frequency of the operating band of the radiating elements.

In some embodiments, the spacing between two adjacent arrays of radiating elements in the first direction is in the range of 0.4 to 0.8 times the wavelength corresponding to the center frequency of the operating band of the radiating elements.

In some embodiments, the spacing between two adjacent radiating elements in each array of radiating elements in the second direction is in the range of 0.5 to 0.8 times the wavelength corresponding to the center frequency of the operating band of the radiating elements.

According to a second aspect of the present invention, a base station antenna is provided. The base station antenna comprises a plurality of linear arrays of radiating elements and phase shifters, characterized in that, each array of radiating elements comprises one or more first sub-arrays of radiating elements composed of n adjacent radiating elements, and one or more second sub-arrays of radiating elements composed of m adjacent radiating elements, where n is greater than m, wherein the n radiating elements in each of the first sub-arrays of radiating elements are electrically connected to a same output end of a phase shifter, and the m radiating elements in each of the second sub-arrays of radiating elements are electrically connected to a same output end of a phase shifter, wherein the plurality of arrays of radiating elements are arranged spaced apart from each other in a first direction, and the radiating elements in each of the arrays of radiating elements are arranged in a second direction substantially perpendicular to the first direction, and two adjacent arrays of radiating elements are staggered from one another in the second direction, wherein the first sub-arrays of radiating elements and the second sub-arrays of radiating elements in each array of radiating elements are configured such that phase centers of the first sub-arrays of radiating elements in each array of radiating elements are staggered from phase centers of the corresponding second sub-arrays of radiating elements in the adjacent array of radiating elements by an amount less than 50% of the amount by which two adjacent arrays of radiating elements are staggered in the second direction.

In some embodiments, the upper limit of the ratio of the amount by which phase centers of the first sub-arrays of radiating elements in each array of radiating elements are staggered from phase centers of the corresponding second sub-arrays of radiating elements in the adjacent array of radiating elements to the amount by which two adjacent arrays of radiating elements are staggered in the second direction is one of the following values: 0.4, 0.3, 0.2, 0.1 and 0.05.

In some embodiments, phase centers of the first sub-arrays of radiating element in each of the arrays of radiating elements are substantially aligned with phase centers of the corresponding second sub-arrays of radiating elements in the adjacent array of radiating elements respectively.

In some embodiments, each array of radiating elements at least partially comprises alternately arranged first sub-arrays of radiating elements and second sub-arrays of radiating elements.

In some embodiments, the n radiating elements in the respective first sub-arrays of radiating elements are electrically connected to a same output end of a phase shifter via a corresponding power divider and/or signal transmission line, and the m radiating elements in the respective second sub-arrays of radiating elements are electrically connected to a same output end of a phase shifter via a corresponding power divider and/or signal transmission line.

In some embodiments, the electrical signals received by the n radiating elements in the respective first sub-arrays of radiating elements from a feed node of the base station antenna are capable of being changed by the same amount of phase via the phase shifter assigned thereto, and the electrical signals received by the m radiating elements in the respective second sub-arrays of radiating elements from a feed node of the base station antenna are capable of being changed by the same amount of phase via the phase shifter assigned thereto.

In some embodiments, the first sub-arrays of radiating elements in each of the arrays of radiating elements are on the direct left or right side of the second sub-arrays of radiating elements corresponding to the first sub-arrays of radiating elements in the first direction.

In some embodiments, at least one of the first sub-arrays of radiating elements in at least one of the arrays of radiating elements does not have a corresponding second sub-array of radiating elements in the adjacent array of radiating elements.

In some embodiments, two adjacent arrays of radiating elements are staggered in the second direction such that the feed point of each radiating element in one array of radiating elements is within the spacing between the feed points of two adjacent radiating elements in the other array of radiating elements in the second direction.

According to a third aspect of the present invention, a base station antenna is provided. The base station antenna comprising a first column and second column of radiating elements adjacent in the horizontal direction and a plurality of phase shifters, wherein each column of radiating elements includes a plurality of radiating elements arranged in the vertical direction, and the first and second columns of radiating elements are staggered from each other in the vertical direction, characterized in that, each column of radiating elements comprises one or more first subset composed of n adjacent radiating elements, and one or more second subset composed of m adjacent radiating elements, wherein n is greater than m, wherein the first and second subsets of the first column of radiating elements are alternately arranged in the vertical direction in a first pattern, and the first and second subsets of the second column of radiating elements are alternately arranged in the vertical direction in a second pattern, wherein the first pattern is different from the second pattern, so that in the horizontal direction, each first subset in the first column of radiating elements is located on the direct left or right side of the second subset of the second column of radiating elements corresponding to the first subset in the first column of radiating elements, wherein, each subset is electrically connected to a same output end of a phase shifter.

In some embodiments, the extension range of the second subset that corresponds to the first subset in the vertical direction is within the extension range of the first subset in the vertical direction.

According to a fourth aspect of the present invention, a base station antenna is provided. The base station antenna comprises: a plurality of first radiating elements that are arranged as a first vertically-extending array; a plurality of second radiating elements that are arranged as a second vertically-extending array, where the second radiating elements are staggered in the vertical direction with respect to the first radiating elements; wherein phase centers in an azimuth plane for first sub-arrays of the first radiating elements are substantially the same as phase centers in the azimuth plane for respective third sub-arrays of the second radiating elements, and wherein the first sub-arrays each have a first number of first radiating elements and the third sub-arrays each have a second number of second radiating elements, the first number being different than the second number.

In some embodiments, phase centers in an azimuth plane for second sub-arrays of the first radiating elements are substantially the same as phase centers in the azimuth plane for respective fourth sub-arrays of the second radiating elements.

In some embodiments, each first sub-array has a respective extension range in the vertical direction, and each third sub-array is positioned within the extension range of a corresponding first sub-array in the vertical direction.

In some embodiments, the base station antenna further comprises a first phase shifter that is coupled to the first vertically-extending array and a second phase shifter that is coupled to the second vertically-extending array, the base station antenna further characterized in that: the radiating elements in each respective first sub-array of radiating elements are electrically connected to respective ones of a first subset of outputs of the first phase shifter, and the radiating elements in each respective third sub-array of radiating elements are electrically connected to respective ones of a second subset of outputs of the second phase shifter.

In some embodiments, the radiating elements in each respective second sub-array of radiating elements are electrically connected to respective ones of a second subset of outputs of the first phase shifter, and the radiating elements in each respective fourth sub-array of radiating elements are electrically connected to respective ones of a first subset of outputs of the second phase shifter.

In some embodiments, radio frequency ("RF") signals received by the radiating elements in each respective first sub-array of radiating elements from a first feed node of the base station antenna have a same respective phase, and the RF signals received by the radiating elements in each respective third sub-array of radiating elements from a second feed node of the base station antenna have a same respective phase.

In some embodiments, the first vertically-extending array at least partially comprises alternately arranged first sub-arrays of radiating elements and second sub-arrays of radiating elements, and the second vertically-extending array at least partially comprises alternately arranged third sub-arrays of radiating elements and fourth sub-arrays of radiating elements.

In some embodiments, at least one of the first sub-arrays of radiating elements in the first vertically-extending array does not have a corresponding third sub-array of radiating elements in the second vertically-extending array.

In some embodiments, phase centers of the first sub-arrays of radiating element are offset from phase centers of the corresponding third sub-arrays of radiating elements by an amount less than the amount by which the first and second vertically-extending arrays are staggered in the vertical direction.

In some embodiments, the first number is equal to the second number plus 1.

In some embodiments, the first and second vertically extending arrays each include one or more first sub-arrays of radiating elements that each have exactly two radiating elements, and one or more second sub-arrays of radiating elements that each have exactly one radiating element.

In some embodiments, the first and second vertically extending arrays each include one or more first sub-arrays of radiating elements that each have exactly three radiating elements, and one or more second sub-arrays of radiating elements that each have exactly two radiating elements.

In some embodiments, the first and second vertically extending arrays each include one or more first sub-arrays of radiating elements that each have exactly four radiating elements, and one or more second sub-arrays of radiating elements that each have exactly three radiating elements.

In some embodiments, the first and second vertically extending arrays each include one or more first sub-arrays of radiating elements that each have exactly five radiating elements, and one or more second sub-arrays of radiating elements that each have exactly four radiating elements.

In some embodiments, the amount by which the first and second vertically-extending arrays are staggered in the vertical direction is in the range of 0.2 to 0.4 times the wavelength corresponding to the center frequency of the operating band of the first and second vertically-extending arrays.

In some embodiments, the spacing between the first and second vertically-extending arrays in the horizontal direction is in the range of 0.4 to 0.8 times the wavelength corresponding to the center frequency of the operating band of the first and second vertically-extending arrays.

DETAILED DESCRIPTION

Figure 1:
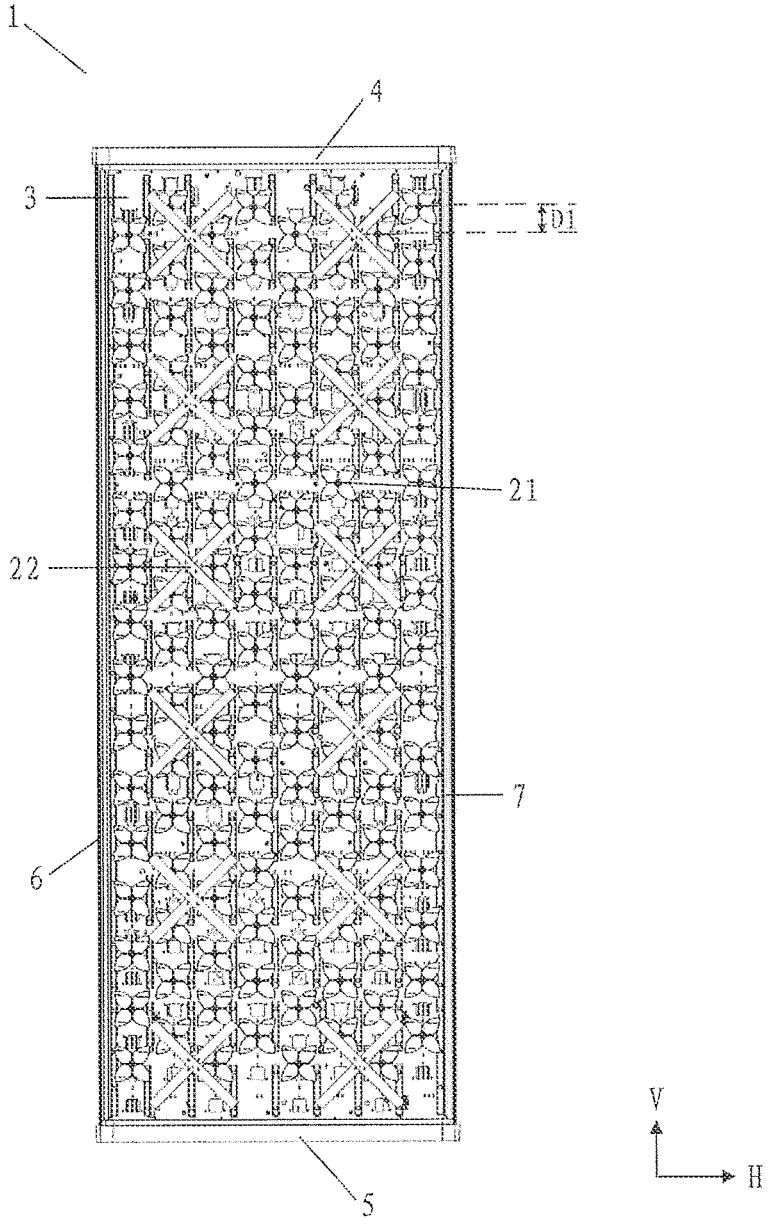
FIG. 1 is a schematic front view of a base station antenna with a radome thereof removed, the base station antenna including a plurality of arrays of high-band radiating elements that are staggered with respect to each other and a plurality of arrays of low-band radiating elements that are not staggered with respect to each other.

Embodiments of the present invention will be described below with reference to the drawings, in which several embodiments of the present invention are shown. It should be understood, however, that the present invention may be implemented in many different ways, and is not limited to the example embodiments described below. In fact, the embodiments described hereinafter are intended to make a more complete disclosure of the present invention and to adequately explain the scope of the present invention to a person skilled in the art. It should also be understood that, the embodiments disclosed herein can be combined in various ways to provide many additional embodiments.

It should be understood that, the wording in the specification is only used for describing particular embodiments and is not intended to limit the present invention. All the terms used in the specification (including technical and scientific terms) have the meanings as normally understood by a person skilled in the art, unless otherwise defined. For the sake of conciseness and/or clarity, well-known functions or constructions may not be described in detail.

The singular forms "a/an" and "the" as used in the specification, unless clearly indicated otherwise, all contain the plural forms. The words "comprising", "containing" and "including" when used in the specification indicate the presence of the claimed features, but do not preclude the presence of one or more additional features. The wording "and/or" as used in the specification includes any and all combinations of one or more of the relevant items listed.

In the specification, words describing spatial relationships such as "up", "down", "left", "right", "forth", "back", "high", "low" and the like may describe a relation of one feature to another feature in the drawings. It should be understood that these terms also encompass different orientations of the apparatus in use or operation, in addition to encompassing the orientations shown in the drawings. For example, when the apparatus shown in the drawings is turned over, the features previously described as being "below" other features may be described to be "above" other features at this time. The apparatus may also be otherwise oriented (rotated 90 degrees or at other orientations) and the relative spatial relationships will be correspondingly altered.

It should be understood that, in all the drawings, the same reference signs present the same elements. In the drawings, for the sake of clarity, the sizes of certain features may be modified.

The beam-forming base station antennas according to embodiments of the present invention are applicable to various types of wireless communication networks. These beam-forming base station antennas include a plurality of arrays of radiating elements. These arrays of radiating elements may, for example, be a linear array of radiating elements or a two-dimensional array of radiating elements. These arrays of radiating elements may be mounted in a row on a reflector of the antenna to provide a base station antenna in accordance with embodiments of the present invention.

As described above, as the arrays of radiating elements (for example, one or more arrays of high-band radiating elements and/or one or more arrays of low-band radiating elements) are spaced more closely together to improve the electronic scanning capabilities of the antenna in the azimuth plane, the spacing between the radiating elements is reduced. This reduced spacing degrades the isolation between radiating elements in adjacent arrays, especially between radiators (e.g., dipoles) that have the same polarization (also referred to as Co-pol isolation). Thus, it may be necessary to improve the isolation between radiating elements in adjacent arrays in order to improve the beamforming performance of the base station antenna. For this purpose, the two adjacent arrays of radiating elements may be staggered with respect to each other, that is, the feed points of the radiating elements in two adjacent arrays of radiating elements are staggered in a vertical direction, i.e., not horizontally aligned with each other. This increases the spatial distance between the radiators having the same polarization of adjacent radiating elements, thereby improving the isolation.

However, the staggered arrangement of the arrays of radiating elements may cause the equivalent phase centers of the adjacent arrays of radiating elements to be offset from each other, thereby creating a spatial phase difference between the adjacent arrays of radiating elements. The spatial phase difference may distort the shape of the radiation pattern (also referred to herein as an "antenna beam") of the base station antenna and thus affect the RF performance of the base station antenna. The phase center of a radiating element should be understood as a theoretical point, that is to say, it is theoretically considered that signals radiated by the radiating element are radiated outward with this theoretical point as a center. With an increase in the electrical downtilt angle of the base station antenna, the radiation pattern may be distorted more severely due to the staggered arrangement of the arrays of radiating elements. Thus, it may be necessary to compensate for the spatial phase differences by, for example, assigning different amplitude and/or phase weights to different arrays of radiating elements. Such compensation measures, however, may increase the design difficulty and/or cost of the antenna system.

Next, embodiments of the present invention will be described in more detail with reference to the accompanying drawings, in which exemplary embodiments are described.

FIG. 1 is a schematic front view of a conventional base station antenna 1 with a radome thereof removed. The base station antenna 1 includes a reflector 3. A plurality of arrays of radiating elements 2 are mounted on the reflector 3. These arrays of radiating elements are each constructed as a linear array of radiating elements. The base station antenna 1 includes eight arrays of high-band radiating elements 21 and two arrays of low-band radiating elements 22, in other words, eight columns of high-band radiating elements 21 and two columns of low-band radiating elements 22 are mounted on the reflector 3.

Each array of high-band radiating elements 21 includes sixteen high-band radiating elements that are spaced apart from each other in a vertical direction V (extending from a top end 4 to a bottom end 5 of the antenna). Likewise, each array of low-band radiating elements 22 includes six low-band radiating elements that are spaced apart from each in the vertical direction V. Further, the arrays of high-band radiating elements 21 are spaced apart from each other at a distance in a horizontal direction H (from a side wall 6 to the opposite side wall 7 of the antenna), and adjacent arrays of high-band radiating elements 21 are staggered with respect to each other in the vertical direction V, that is, the feed points of the high-band radiating elements in any two adjacent arrays of high-band radiating elements 21 are not aligned with each other in the horizontal direction H. As can be seen from FIG. 1, the feed points (which for ease of description are assumed to be at the center of the radiating elements where the two dipole radiators cross when viewed from the front) of the high-band radiating elements in any two adjacent arrays of high-band radiating elements 21 are staggered with respect to each other by a distance of D1 in the vertical direction V. The distance D1 by which the adjacent arrays of radiating elements are staggered from each other in the vertical direction V may be in the range of 0.2 to 0.4 times the wavelength corresponding to the center frequency of the operating frequency band of these arrays of radiating elements. This increases the spatial separation between the dipoles of the same polarization of any two adjacent radiating elements from different arrays, thereby improving the isolation between adjacent arrays.

As shown in FIG. 1, the arrays of low-band radiating elements 22 are spaced apart from each other in the horizontal direction H, and the arrays of low-band radiating elements 22 are aligned with each other in the vertical direction V, that is, the feed points of the low-band radiating elements in the two adjacent arrays of low-band radiating elements 22 are aligned with each other in the horizontal direction H.

As described above, although the spatially staggered arrangement of the two adjacent arrays of radiating elements 2 facilitates an increase in isolation, this may cause the equivalent phase centers of the two adjacent arrays of radiating elements 2 to be spatially offset from each other, thereby distorting the radiation pattern of the base station antenna 1. Thus, how to maintain the advantages of the staggered arrangement of the arrays of radiating elements 2 while reducing or eliminating the disadvantages thereof is a technical problem to be solved by those skilled in the art.

Figure 2:
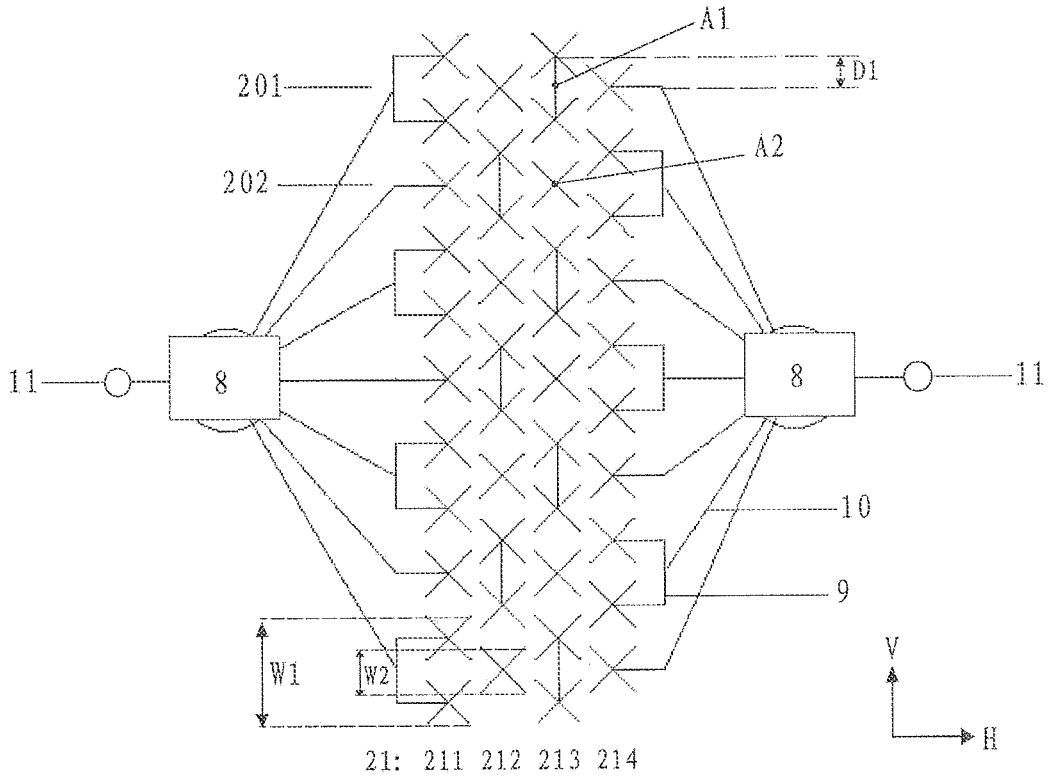
FIGS. 2-4 are schematic front views of base station antennas according to various embodiments of the present invention with the radomes thereof removed that include staggered arrays of high-band radiating elements.

FIG. 2 is a schematic front view of a base station antenna according to a first embodiment of the present invention. In the embodiment of FIG. 2, four linear arrays of high-band radiating elements 21 are shown, but it will be appreciated that more or fewer linear arrays of high band radiating elements 21 may be included in the base station antenna in other embodiments. The arrays of high-band radiating elements 21 may each have a plurality of high-band radiating elements that are spaced apart from one another in the vertical direction V (which extends from the top end to the bottom end of the antenna). Further, the arrays of high-band radiating elements 21 are spaced apart from one another in the horizontal direction H, and the adjacent arrays of high-band radiating elements 21 are staggered from one another in the vertical direction V, that is, the feed points of the high-band radiating elements in each pair of two adjacent arrays of high-band radiating elements 21 are staggered from one another in the vertical direction V, that is, not aligned with each other. As can be seen from FIG. 2, the feed points (the dipole centers) of the high-band radiating elements in adjacent arrays of high-band radiating elements 21 are staggered from each other by a distance of D1 in the vertical direction V.

The base station antenna of FIG. 2 further includes phase shifters 8, with two phase shifters 8 provided for each array of radiating elements 21 (namely, a phase shifter for the radiators having each polarization). Only two of the eight phase shifters 8 are illustrated in FIG. 2 in order to simplify the drawing.

As is further shown in FIG. 2, each of the arrays of radiating elements 21 includes a plurality of first sub-arrays of radiating elements 201 that each include two adjacent radiating elements, and a plurality of second sub-arrays of radiating elements 202 that each include a single radiating element. The first polarization radiators of the radiating elements in each of the first sub-arrays of radiating elements 201 are "collectively fed" via a phase shifter 8, and the first polarization radiators of the radiating elements in each of the second sub-arrays of radiating elements 202 are "collectively fed" via the same phase shifter 8.

Herein, the radiating elements of a sub-array are "collectively fed" if all the radiating elements in the sub-array are electrically connected to the same output of a particular phase shifter 8 via a power divider 9 and/or signal transmission lines 10. That is to say, the RF signals received by the radiating elements in a collectively fed sub-array of radiating elements 201, 202 from a feed node 11 of the base station antenna will have the same amount of phase shift applied thereto via the phase shifter 8 assigned thereto. Consequently, will have the same phase. If the amplitudes of the RF signals emitted by the two radiating elements are also the same, then the equivalent phase center of the radiating elements in the sub-array of radiating elements 201 may be located halfway between the two radiating elements along a vertical axis that extends through the two radiating elements. Thus, the equivalent phase centers A1 of each first sub-array of radiating elements 201 may be midway between the two radiating elements in the vertical direction, whereas the phase centers A2 of the second sub-arrays of radiating elements 202 may be in the center of the single radiating elements that form each second sub-array 202, that is, at the feeding point of the radiating element.

In the present embodiment, the four arrays of high-band radiating elements 21 include, from left to right in order, a first array of high-band radiating elements 211, a second array of high-band radiating elements 212, a third array of high-band radiating elements 213 and fourth array of high-band radiating elements 214. The first array of high-band radiating elements 211 and the third array of high-band radiating elements 213 are configured in the same way, and the second array of high-band radiating elements 212 and the fourth array of high-band radiating elements 214 are configured in the same way. As used herein, "configured in the same way" means that the number of the radiating elements in the array and the arrangement order of the sub-arrays are the same, that is, in the corresponding array of radiating elements, the sub-arrays are arranged in a same order in the vertical direction.

As shown in FIG. 2, the numbers of radiating elements in two adjacent arrays of radiating elements differ from one another. The first and third arrays of high-band radiating elements 211, 213 in FIG. 2 each have seven sub-arrays of radiating elements 201, 202, namely four first sub-arrays of radiating elements 201 and three second sub-arrays of radiating elements 202 (a total of eleven radiating elements calculated as 4*2+3*1=11). The second and fourth arrays of high-band radiating elements 212, 214 also each have seven sub-arrays of radiating elements 201, 202, but include three first sub-arrays of radiating elements 201 and four second sub-arrays of radiating elements 202 (a total of ten radiating elements calculated as 3*2+4*1=10). Each of the sub-arrays 201, 202 is electrically connected to an output of the phase shifter 8 via a corresponding power divider 9 and/or a signal transmission line 10. Each first sub-array of radiating elements 201 in the first array of high-band radiating elements 211 is mounted horizontally adjacent to a second sub-array of radiating element 202 in the second array of high-band radiating elements 212 respectively, and each second sub-array of radiating elements 202 in the first array of high-band radiating elements 211 is mounted horizontally adjacent to a first sub-array of radiating elements 201 in the second array of high-band radiating elements 212. In other words, each first sub-array of radiating elements 201 in the first array of high-band radiating elements 211 is mounted directly to the left side of a corresponding second sub-array of radiating elements 202 in the second array of high-band radiating elements 212 in the horizontal direction; and each second sub-array of radiating elements 202 in the first array of high-band radiating elements 211 is mounted directly to the left side of a corresponding first sub-array of radiating elements 201 in the second array of high-band radiating elements 212. Thus, phase centers of the first sub-arrays of radiating elements 201 in the first array of high-band radiating elements 211 are substantially aligned in the horizontal direction (i.e., in the azimuth plane) with the phase centers of the corresponding second sub-arrays of radiating elements 202 in the second array of high-band radiating elements 212 respectively, and phase centers of the second sub-arrays of radiating elements 202 in the first array of high-band radiating elements 211 are substantially aligned in the horizontal direction with phase centers of the corresponding first sub-arrays of radiating elements 201 in the second array of high-band radiating elements 212 respectively.

Likewise, phase centers of the first sub-arrays of radiating elements 201 in the third array of high-band radiating elements 213 are substantially aligned in the horizontal direction with phase centers of the corresponding second sub-array of radiating elements 202 in the second array of high-band radiating elements 212 respectively, and phase centers of the second sub-arrays of radiating elements 202 in the third array of high-band radiating elements 213 are substantially aligned in the horizontal direction with phase centers of the corresponding first sub-arrays of radiating elements 201 in the second array of high-band radiating elements 212 respectively.

Likewise, phase centers of the first sub-arrays of radiating elements 201 in the third array of high-band radiating elements 213 are substantially aligned in the horizontal direction with phase centers of the corresponding second sub-arrays of radiating elements 202 in the fourth array of high-band radiating elements 214 respectively, and phase centers of the second sub-arrays of radiating elements 202 in the third array of high-band radiating elements 213 are substantially aligned in the horizontal direction with phase centers of the corresponding first sub-arrays of radiating elements 201 in the fourth array of high-band radiating elements 214 respectively.

It should be understood that the phase center is a theoretical point for an ideal antenna. However, in the actual antenna, the phase center may also be a region as opposed to a point. Therefore, pursuant to embodiments of the present invention is the first sub-arrays of radiating element 201 and the second sub-array of radiating elements 202 in each array of radiating elements 21 may be configured such that, in the vertical direction V, phase centers of the first sub-arrays of radiating element 201 in each array of radiating elements 21 are respectively offset from phase centers of the corresponding second sub-arrays of radiating element 202 in the adjacent array of radiating elements 21 by an amount less than 0.5, 0.4, 0.3, 0.2, 0.1 or 0.05 times the amount by which the two adjacent arrays of radiating elements are staggered in the vertical direction V. In some embodiments, phase centers of the first sub-arrays of radiating element 201 in each of the arrays of radiating elements 21 may be substantially aligned with phase centers of the corresponding second sub-arrays of radiating elements 202 in the adjacent array of radiating elements. The smaller the amount by which the phase centers are offset, the less the radiation pattern is distorted, so that the RF performance of the base station antenna is improved.

With respect to the base station antenna according to the first embodiment of the present invention illustrated in FIG. 2, the advantages of the staggered arrangement of the arrays of radiating elements 21 are maintained while the offset in the phase centers is reduced or even eliminated by optimized arrangement of the arrays of radiating elements, improving the RF performance of the base station antenna.

The base station antenna of FIG. 2 also differs from the conventional base station antenna 1 in the layout of the sub-arrays of radiating elements 201, 202. As shown in FIG. 2, the first sub-array of radiating elements 201 extends a distance W1 in the vertical direction V, and the second sub-array of radiating elements 202 that corresponds to the first sub-array of radiating elements 201 extends a distance W2 in the vertical direction V. It can be seen that W2 is within W1 in the vertical direction V, and preferably W2 is in the central region of W1 in the vertical direction V.

Thus, the first sub-arrays of radiating elements 201 and the second sub-arrays of radiating elements 202 in a first array of radiating elements 21 are arranged in a first order in the vertical direction V, and the first sub-arrays of radiating elements 201 and the second sub-arrays of radiating elements 202 in a second array of radiating elements that is adjacent the first array of radiating elements 21 are arranged in a second order in the vertical direction V that is different from first order. As a result, each first sub-array of radiating elements 201 in an array of radiating elements 21 is located, in the horizontal direction H, directly next to a second sub-array of radiating elements 202 of an adjacent array. Each first sub-array of radiating elements 201 thus may have a corresponding second sub-array of radiating elements 202 located on its direct left side, its direct right side, or on both its direct left side and its direct right side, in the horizontal direction, as shown in FIG. 2. "Direct left side" and "direct right side" means that the extension range of the second sub-array of radiating elements 202 in the vertical direction V is within, preferably in the central region of, the extension range of the corresponding first sub-array of radiating elements 201 in the vertical direction V.

Figure 3:
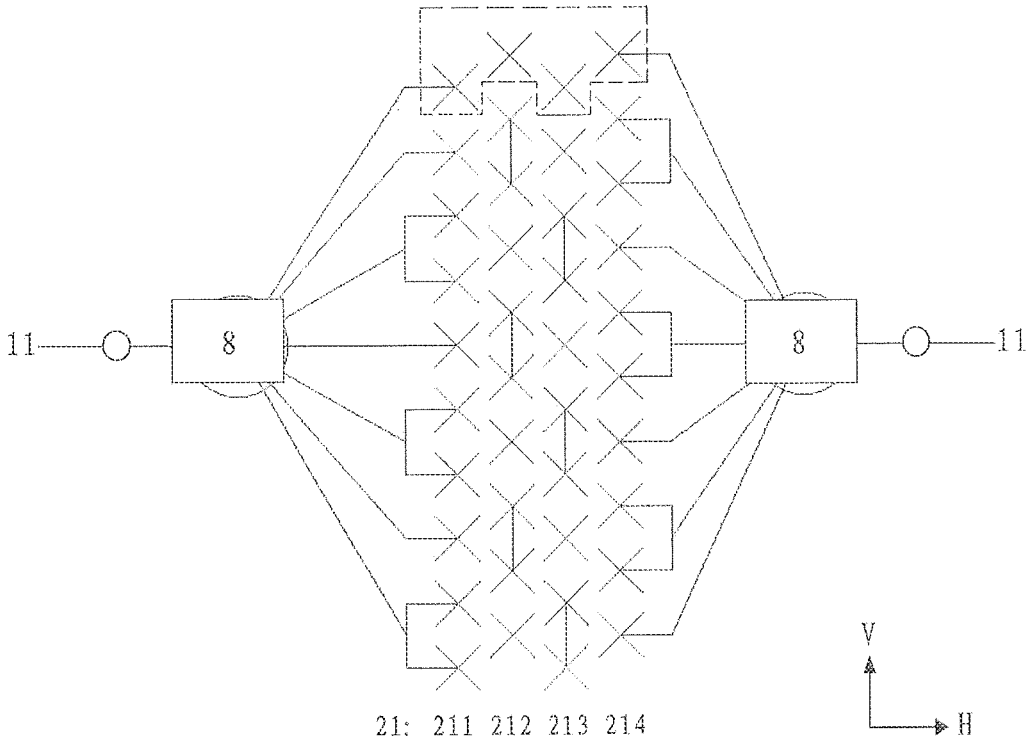

FIG. 3 is a schematic front view of a base station antenna according to a second embodiment of the present invention. For the sake of conciseness, only differences between the base station antenna of FIG. 2 and the base station antenna of FIG. 3 will be described below.

As shown in FIG. 3, the number of the radiating elements in each array of radiating elements is the same in the embodiment of FIG. 3. The first and third arrays of high-band radiating elements 211, 213 in FIG. 3 each have seven sub-arrays of radiating elements 201, 202 from top to bottom, respectively: three first sub-arrays of radiating elements 201 that each include two radiating elements, and four second sub-arrays of radiating elements 202 that each include one radiating element. Thus, each array 211, 213 includes a total of ten radiating elements calculated as 3*2+4*1=10. The second and fourth arrays of high-band radiating elements 212, 214 has also each have seven sub-arrays of radiating elements 201, 202 from top to bottom, respectively: three first sub-arrays of radiating elements 201 that each include two radiating elements, and four second sub-arrays of radiating elements 202 that each include one radiating element. Thus, each array 212, 214 includes a total of ten radiating elements calculated as 3*2+4*1=10.

Unlike the embodiment of FIG. 2, the sub-arrays of radiating elements bordered by dashed lines in the embodiment of FIG. 3 do not have corresponding sub-arrays of radiating elements in the adjacent array of radiating elements respectively. In the present embodiment, the first sub-arrays of radiating elements 201 at the top end of the antenna in the array of radiating elements 21 do not have corresponding second sub-arrays of radiating elements 202 in the adjacent array of radiating elements respectively.

In other embodiments, the sub-arrays of radiating elements 201 at the bottom end of the antenna in the array of radiating elements 21 may additionally or alternatively not have corresponding second sub-arrays of radiating elements 202 in the adjacent array of radiating elements respectively. Experiments have shown that the absence of corresponding sub-arrays of radiating elements for a few sub-arrays of radiating elements may not produce a significant negative effect on the RF performance of the base station antenna. Moreover, the base station antenna of FIG. 3 may advantageously have a reduced size, reduced wind load and/or reduced manufacturing costs.

Figure 4:
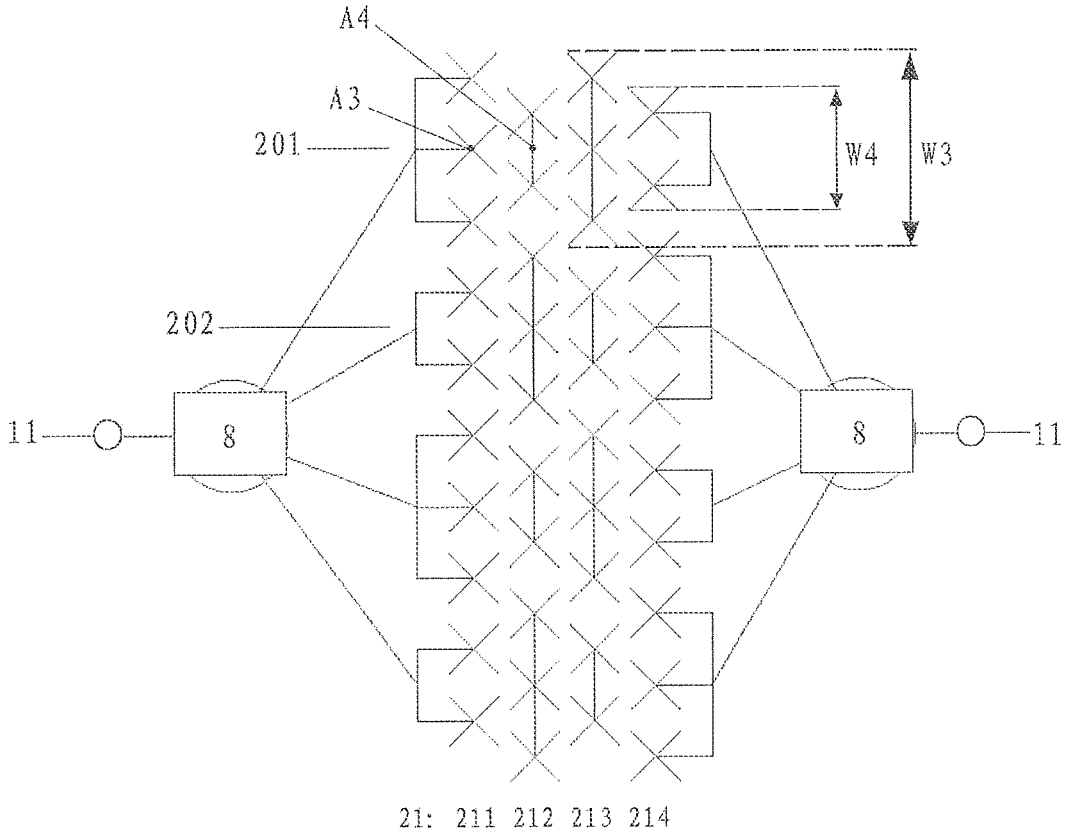

FIG. 4 is a schematic front view of a base station antenna according to a third embodiment of the present invention. For the sake of conciseness, only differences between the embodiment of FIG. 4 and the above-described embodiments of FIGS. 2 and 3 will be described below.

As shown in FIG. 4, the number of radiating elements in each array of radiating elements 211, 212, 213, 214 is the same, as is also the case with the base station antenna of FIG. 3. The first and third arrays of high-band radiating elements 211, 213 in FIG. 4 each have four sub-arrays of radiating elements 201, 202 from top to bottom, respectively: two first sub-arrays of radiating elements 201 that each include three radiating elements, and two second sub-arrays of radiating elements 202 that each include two radiating elements, for a total of ten radiating elements calculated as 2*3+2*2=10. The second and fourth arrays of high-band radiating elements 212, 214 also each have four sub-arrays of radiating elements 201, 202 from top to bottom, respectively: two second sub-arrays of radiating elements 202 that each include two radiating elements, and two first sub-arrays of radiating elements 201 that each include three radiating elements, for a total of ten radiating elements calculated as 2*2+2*3=10.

In the present embodiment, the first sub-arrays of radiating elements 201 in the first array of high-band radiating elements 211 correspond to (i.e., are adjacent to in the horizontal direction) the second sub-arrays of radiating elements 202 in the second array of high-band radiating elements 212 respectively, and the second sub-arrays of radiating elements 202 in the first array of high-band radiating elements 211 correspond to the first sub-arrays of radiating elements 201 in the second array of high-band radiating elements 212 respectively. Thus, phase centers of the first sub-arrays of radiating elements 201 in the first array of high-band radiating elements 211 are substantially aligned with phase centers of their corresponding second sub-arrays of radiating elements 202 in the second array of high-band radiating elements 212 in the horizontal direction. Phase centers of the second sub-arrays of radiating elements 202 in the first array of high-band radiating elements 211 are substantially aligned with phase centers of their corresponding first sub-arrays of radiating elements 201 in the second array of high-band radiating elements 212 in the horizontal direction.

Likewise, phase centers of the first sub-arrays of radiating elements 201 in the third array of high-band radiating elements 213 are substantially aligned with the phase centers of their corresponding second sub-arrays of radiating elements 202 in the second array of high-band radiating elements 212 in the horizontal direction H, and phase centers of the second sub-arrays of radiating elements 202 in the third array of high-band radiating elements 213 are substantially aligned with phase centers of their corresponding first sub-arrays of radiating elements 201 in the second array of high-band radiating elements 212 in the horizontal direction H.

Likewise, phase centers of the first sub-arrays of radiating elements 201 in the third array of high-band radiating elements 213 are substantially aligned with phase centers of their corresponding second sub-arrays of radiating elements 202 in the fourth array of high-band radiating elements 214 in the horizontal direction H, and phase centers of the second sub-arrays of radiating elements 202 in the third array of high-band radiating elements 213 are substantially aligned with phase centers of their corresponding first sub-arrays of radiating elements 201 in the fourth array of high-band radiating elements 214 in the horizontal direction H.

As shown in FIG. 4, the equivalent phase center A3 of the first sub-array of radiating elements 201 may be located at the feed point of the intermediate radiating element in this array, and the phase center A4 of the second sub-array of radiating elements 202 may be located in the center between the two radiating elements in the sub-array.

Further, as can be seen, the first sub-array of radiating elements 201 extends a distance W3 in the vertical direction V, and the second sub-array of radiating elements 202 that corresponds to the first sub-array of radiating elements 201 extends a distance W4 in the vertical direction V. It can be seen that W4 is within W3, and preferably W4 is in the central region of W3.

It should be understood that the number of the arrays of radiating elements in the base station antennas according to embodiments of the present invention and the number and arrangement of the sub-arrays of radiating elements in each array of radiating elements may be varied from the example embodiments discussed above. For example, in other embodiments, there may be more than four arrays of radiating elements. It will also be appreciated that additional arrays of radiating elements may also be included in the above-described base station antennas such as, for example, one or more arrays of low-band radiating elements as discussed above with reference to FIG. 1. It will further be appreciated that the techniques disclosed herein may be used with radiating elements that operate in any frequency band.

As one additional example, a base station antenna according to further embodiments of the present invention includes arrays of radiating elements that have four sub-arrays of radiating elements: two first sub-arrays of radiating elements that each include four adjacent radiating elements, and two second sub-arrays of radiating elements that each include three adjacent radiating elements (a total of 14 radiating elements calculated as 2*4+2*3=14); the adjacent arrays of radiating elements each include four sub-arrays of radiating elements: two adjacent second sub-arrays of radiating elements that each include three radiating elements, and two first sub-arrays of radiating elements 201 that each include four adjacent radiating elements (a total of fourteen radiating elements calculated as 2*3+2*4=14).

Although the specific embodiments of the present disclosure have been described in detail by way of example, those skilled in the art should understand that the above examples are for illustrative purposes only and are not intended to limit the scope of the present disclosure. The various embodiments disclosed herein may be combined in any combination without departing from the spirit and scope of the disclosure. It should also be understood by those skilled in the art that various modifications may be made in the embodiments without departing from the scope and spirit of the disclosure.

What is claimed is:

1. A base station antenna, comprising a plurality of linear arrays of radiating elements and phase shifters, wherein each array of radiating elements comprises one or more first sub-arrays of radiating elements composed of n adjacent radiating elements, and one or more second sub-arrays of radiating elements composed of m adjacent radiating elements, where n is greater than m, wherein the n radiating elements in each of the first sub-arrays of radiating elements are electrically connected to a same output end of a phase shifter, and the m radiating elements in each of the second sub-arrays of radiating elements are electrically connected to a same output end of a phase shifter, wherein the plurality of arrays of radiating elements are arranged spaced apart from each other in a first direction, and the radiating elements in each of the arrays of radiating elements are arranged in a second direction substantially perpendicular to the first direction, and two adjacent arrays of radiating elements are staggered from one another in the second direction, and wherein the first sub-arrays of radiating elements and the second sub-arrays of radiating elements in each array of radiating elements are configured such that phase centers of the first sub-arrays of radiating elements in each array of radiating elements are staggered from phase centers of the corresponding second sub-arrays of radiating elements in the adjacent array of radiating elements by an amount less than 50% of the amount by which two adjacent arrays of radiating elements are staggered in the second direction.

2. The base station antenna according to claim 1, wherein the upper limit of the ratio of the amount by which phase centers of the first sub-arrays of radiating elements in each array of radiating elements are staggered from phase centers of the corresponding second sub-arrays of radiating elements in the adjacent array of radiating elements to the amount by which two adjacent arrays of radiating elements are staggered in the second direction is one of the following values: 0.4, 0.3, 0.2, 0.1 and 0.05.

3. The base station antenna according to claim 1, wherein phase centers of the first sub-arrays of radiating elements in each of the arrays of radiating elements are substantially aligned with phase centers of the corresponding second sub-arrays of radiating elements in the adjacent array of radiating elements respectively.

4. The base station antenna according to claim 1, wherein each array of radiating elements at least partially comprises alternately arranged first sub-arrays of radiating elements and second sub-arrays of radiating elements.

5. The base station antenna according to claim 2, wherein the n radiating elements in the respective first sub-arrays of radiating elements are electrically connected to a same output end of a phase shifter via a corresponding power divider and/or signal transmission line, and the m radiating elements in the respective second sub-arrays of radiating elements are electrically connected to a same output end of a phase shifter via a corresponding power divider and/or signal transmission line.

6. The base station antenna according to claim 2, wherein the electrical signals received by the n radiating elements in the respective first sub-arrays of radiating elements from a feed node of the base station antenna are capable of being changed by the same amount of phase via the phase shifter assigned thereto, and the electrical signals received by the m radiating elements in the respective second sub-arrays of radiating elements from a feed node of the base station antenna are capable of being changed by the same amount of phase via the phase shifter assigned thereto.

7. The base station antenna according to claim 2, wherein the first sub-arrays of radiating elements in each of the arrays of radiating elements are on the direct left or right side of the second sub-arrays of radiating elements corresponding to the first sub-arrays of radiating elements in the first direction.

8. The base station antenna according to claim 2, wherein at least one of the first sub-arrays of radiating elements in at least one of the arrays of radiating elements does not have a corresponding second sub-array of radiating elements in the adjacent array of radiating elements.

9. The base station antenna according to claim 2, wherein two adjacent arrays of radiating elements are staggered in the second direction such that the feed point of each radiating element in one array of radiating elements is within the spacing between the feed points of two adjacent radiating elements in the other array of radiating elements in the second direction.

10. A base station antenna comprising a first column and second column of radiating elements adjacent in the horizontal direction and a first phase shifter and a second phase shifter that are electrically connected to the first column and the second column, respectively, wherein each column of radiating elements includes a plurality of radiating elements arranged in the vertical direction, and the first and second columns of radiating elements are staggered from each other in the vertical direction, wherein each column of radiating elements comprises one or more first subset composed of n adjacent radiating elements, and one or more second subset composed of m adjacent radiating elements, wherein n is greater than m, wherein the first and second subsets of the first column of radiating elements are alternately arranged in the vertical direction in a first pattern, and the first and second subsets of the second column of radiating elements are alternately arranged in the vertical direction in a second pattern, wherein the first pattern is different from the second pattern, so that in the horizontal direction, each first subset in the first column of radiating elements is located on the direct left or right side of the second subset of the second column of radiating elements corresponding to the first subset in the first column of radiating elements, wherein each subset of the first column is electrically connected to a respective output of the first phase shifter, and wherein each subset of the second column is electrically connected to a respective output of the second phase shifter.

11. The base station antenna according to claim 10, wherein each column of radiating elements comprises a plurality of first subsets and a plurality of second subsets.

12. The base station antenna according to claim 10, wherein the extension range of the second subset that corresponds to the first subset in the vertical direction is within the extension range of the first subset in the vertical direction.

13. The base station antenna according to claim 11, wherein n=m+1, wherein the first column of radiating elements comprises j first subsets and k second subsets, wherein the second column of radiating elements comprises k first subsets and j second subsets, and wherein j is not equal to k.

14. A base station antenna comprising:

a plurality of linear arrays of radiating elements and a plurality of phase shifters, each phase shifter configured to pass radio frequency (RF) signals to a corresponding one of the plurality of linear arrays of radiating elements, wherein each linear array of radiating elements comprises one or more first sub-arrays of radiating elements and one or more second sub-arrays of radiating elements, each of the one or more first sub-arrays of radiating elements including n adjacent radiating elements, and each of the one or more second sub-arrays of radiating elements including m adjacent radiating elements, where n is greater than m, wherein each of the one or more first sub-arrays of radiating elements in each linear array of radiating elements is electrically connected to a respective one of a first subset of outputs of a respective one of the plurality of phase shifters that corresponds to each linear array of radiating elements, and each of the one or more second sub-arrays of radiating elements is electrically connected to a respective one of a second subset of outputs of the respective one of the plurality of phase shifters that corresponds to each linear array of radiating elements, wherein the plurality of linear arrays of radiating elements are arranged spaced apart from each other in a first direction, wherein the radiating elements in each linear array of radiating elements are arranged in a second direction that is substantially perpendicular to the first direction, wherein two adjacent linear arrays of radiating elements are staggered with respect to one another in the second direction, and wherein, for each linear array of radiating elements:

n equals two and m equals one;

n equals three and m equals two;

n equals four and m equals three; or n equals five and m equals four.

15. The base station antenna according to claim 14, wherein each array of radiating elements at least partially comprises alternately arranged first sub-arrays of radiating elements and second sub-arrays of radiating elements.

16. The base station antenna according to claim 14, wherein phase centers of the first sub-arrays of radiating elements in each of the arrays of radiating elements are offset from phase centers of the corresponding second sub-arrays of radiating elements in the adjacent array of radiating elements by an amount less than the amount by which two adjacent arrays of radiating elements are staggered in the second direction.

17. The base station antenna according to claim 14, wherein the upper limit of the ratio of the amount by which phase centers of the first sub-arrays of radiating elements in each array of radiating elements are offset from phase centers of the corresponding second sub-arrays of radiating elements in the adjacent array of radiating elements to the amount by which two adjacent arrays of radiating elements are staggered in the second direction is one of the following values: 0.9, 0.8, 0.7, 0.6, 0.5, 0.4, 0.3, 0.2, 0.1 and 0.05.

18. The base station antenna according to claim 14, wherein phase centers of the first sub-arrays of radiating elements in each of the arrays of radiating elements are substantially aligned with phase centers of the corresponding second sub-array of radiating elements in the adjacent array of radiating elements respectively.

19. The base station antenna according to claim 14, wherein the amount by which two adjacent arrays of radiating elements are staggered in the second direction is in the range of 0.2 to 0.4 times the wavelength corresponding to the center frequency of the operating band of the radiating elements.

20. The base station antenna according to claim 14, wherein the spacing between two adjacent arrays of radiating elements in the first direction is in the range of 0.4 to 0.8 times the wavelength corresponding to the center frequency of the operating band of the radiating elements.

* * * * *